US009795935B2

(12) United States Patent
Bello et al.

(10) Patent No.: US 9,795,935 B2
(45) Date of Patent: Oct. 24, 2017

(54) METHOD AND SYSTEM FOR BLENDING NATURAL GAS LIQUIDS INTO HYDROCARBONS

(71) Applicants: Brandon Wade Bello, Spring, TX (US); Brian B. Ballance, Houston, TX (US)

(72) Inventors: Brandon Wade Bello, Spring, TX (US); Brian B. Ballance, Houston, TX (US)

( * ) Notice: Subject to any disclaimer, the term of this patent is extended or adjusted under 35 U.S.C. 154(b) by 0 days.

(21) Appl. No.: 15/398,500

(22) Filed: Jan. 4, 2017

(65) Prior Publication Data

US 2017/0189869 A1 Jul. 6, 2017

Related U.S. Application Data

(60) Provisional application No. 62/274,458, filed on Jan. 4, 2016.

(51) Int. Cl.

| | |
|---|---|
| ***B01F 3/08*** | (2006.01) |
| ***B01F 5/04*** | (2006.01) |
| ***B01F 5/10*** | (2006.01) |
| ***B01F 13/10*** | (2006.01) |
| ***B01F 15/00*** | (2006.01) |
| ***B01F 15/04*** | (2006.01) |
| ***C10L 1/06*** | (2006.01) |

(52) U.S. Cl.

CPC ..... *B01F 3/0865* (2013.01); *B01F 5/043* (2013.01); *B01F 5/10* (2013.01); *B01F 13/1016* (2013.01); *B01F 15/00207* (2013.01); *B01F 15/00344* (2013.01); *B01F 15/0412* (2013.01); *C10L 1/06* (2013.01); *B01F 2215/0086* (2013.01); *C10L 2200/0423* (2013.01); *C10L 2270/023* (2013.01); *C10L 2290/24* (2013.01); *C10L 2290/60* (2013.01)

(58) Field of Classification Search

CPC .... B01F 3/0865; B01F 15/00344; B01F 5/10; B01F 13/1016; B01F 15/00207; B01F 15/0412; B01F 5/043; B01F 2215/0086; C10L 1/06; C10L 2200/0423; C10L 2270/023; C10L 2290/24; C10L 2290/60

See application file for complete search history.

(56) References Cited

U.S. PATENT DOCUMENTS

| | | | | |
|---|---|---|---|---|
| 2,322,087 | A * | 6/1943 | Atwood | B01F 5/0212 366/164.5 |
| 3,385,680 | A | 5/1968 | Feld et al. | |
| 4,371,731 | A | 2/1983 | Washer | |
| 5,004,850 | A | 4/1991 | Wilson | |
| 7,032,629 | B1 * | 4/2006 | Mattingly | G05D 11/131 137/486 |
| 8,176,951 | B2 | 5/2012 | Mattinglt et al. | |
| 8,192,510 | B2 | 6/2012 | Mattingly et al. | |
| 2005/0058016 | A1 | 3/2005 | Smith et al. | |
| 2014/0194657 | A1 | 7/2014 | Wadhwa et al. | |

* cited by examiner

*Primary Examiner* — Randy Boyer
*Assistant Examiner* — Juan Valencia
(74) *Attorney, Agent, or Firm* — Plager Schack LLP

(57) ABSTRACT

A method and system for blending natural gas liquids into liquid hydrocarbons may include using multiple blending tanks with internal mixer eductors, a plurality of analyzers, and, optionally, a recirculation tank, wherein natural gas liquid may be added into the system at each blending tank, creating a more accurately mixed final product.

5 Claims, 2 Drawing Sheets

METHOD AND SYSTEM FOR BLENDING NATURAL GAS LIQUIDS INTO HYDROCARBONS

RELATED APPLICATION

This application claims priority to provisional patent application U.S. Ser. No. 62/274,458 filed on Jan. 4, 2016 entire contents of which is herein incorporated by reference.

BACKGROUND

The embodiments herein relate generally to the blending of natural gas liquids into hydrocarbons and, more particularly, to a method of blending natural gas liquids into liquid hydrocarbons, such as gasoline, using a series of pressurized tanks with internal mixer-eductors.

Natural gas liquids (NGLs) either extracted from natural gas or crude oil, or as a product or byproduct of refining, chemical processing, or biochemical processing may be blended into liquid hydrocarbons for a variety of reasons. For example, butane may be blended into gasoline to increase the value of the butane, to increase the supply of gasoline, and to meet area specific and seasonal specific volatility limits.

Conventional methods for blending NGLs, such as butane, into natural gasoline, motor gasoline, condensate, crude oil, or the like include in-pipe or in-tank blend options only. In-pipe blending does not provide a method of good mixing, resulting in unstable and inconstant volatility measurements. In-tank blending requires long time delays in sampling and measurement and poses risks due to incomplete blending and the use of non-pressurized tanks. Thus, conventional methods do not include a mixer and also do not continuously analyze downstream of the mix point, rather, completion of analysis of conventional methods are a spot analysis in nature, and are delayed in reporting, often following delivery of product to the downstream equipment. The gasoline or crude product quality is inconsistent and, as a result, a significant amount of NGL upgrade value to gasoline or crude product is lost due to the need to maintain a conservative margin of error. Incorrect blending, particularly on the high side, can result in large financial or civil penalties for the blender.

Because the existing systems release hydrocarbon product upon blending and sampling but prior to receiving results of sampling, the chance of off-specification products is increased. To mitigate the risk of off-specification products, the existing systems reduce the amount of NGLs that are blended, thereby being inefficient.

In other words, existing systems do not retain blended product and certify the effectiveness of the blend. Moreover, existing systems are less effective in maximizing blending to reduce chances of off-specification production.

Therefore, what is needed is a blending system and method that provides a more consistent sample to analyze, eliminates stratification and bad mixing, and allows for continuous and accurate monitoring of the gasoline or crude product.

SUMMARY

Some embodiments of the present disclosure include a method and system for blending natural gas liquids into liquid hydrocarbons. The method and system may include using multiple blending tanks with internal mixer eductors, a plurality of analyzers, and, optionally, a recirculation tank, wherein natural gas liquid may be added into the system at each blending tank, creating a more accurately mixed final product. Because of the structure of the system, the blending system and method of the present disclosure may allow for continuous and accurate monitoring of the gasoline or crude product, ensuring effective blending and a reduction of producing off-specification blends.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The method and system of the present disclosure may be used to blend natural gas liquids (NGLs) into liquid hydrocarbons and may comprise the following elements. This list of possible constituent elements is intended to be exemplary only, and it is not intended that this list be used to limit the method and system of the present application to just these elements. Persons having ordinary skill in the art relevant to the present disclosure may understand there to be equivalent elements that may be substituted within the present disclosure without changing the essential function or operation of the device.

1. Multiple Tanks with Internal Mixer/Eductor
2. Recirculation Pump
3. Continuous Product Analysis Equipment The various elements of the method and system of the present disclosure may be related in the following exemplary fashion. It is not intended to limit the scope or nature of the relationships between the various elements and the following examples are presented as illustrative examples only.

Figure 1:
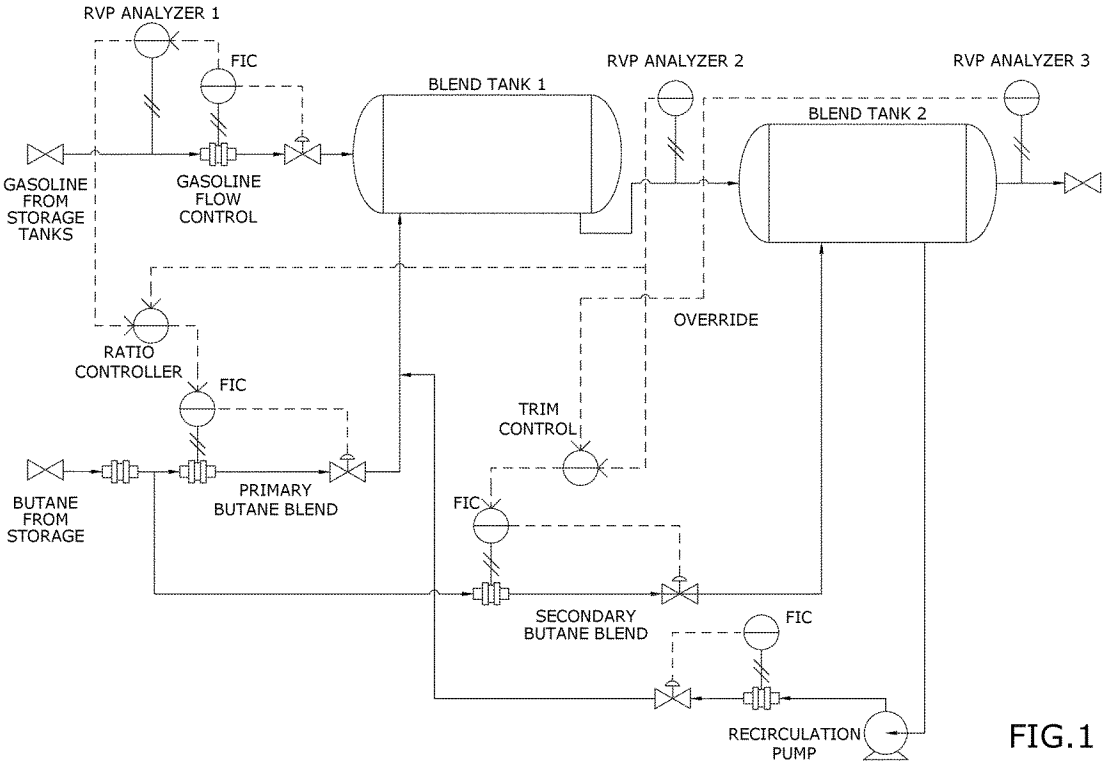
FIG. 1 is a process flow diagram view of one embodiment of the butane blending skid of the present disclosure.
Figure 2:
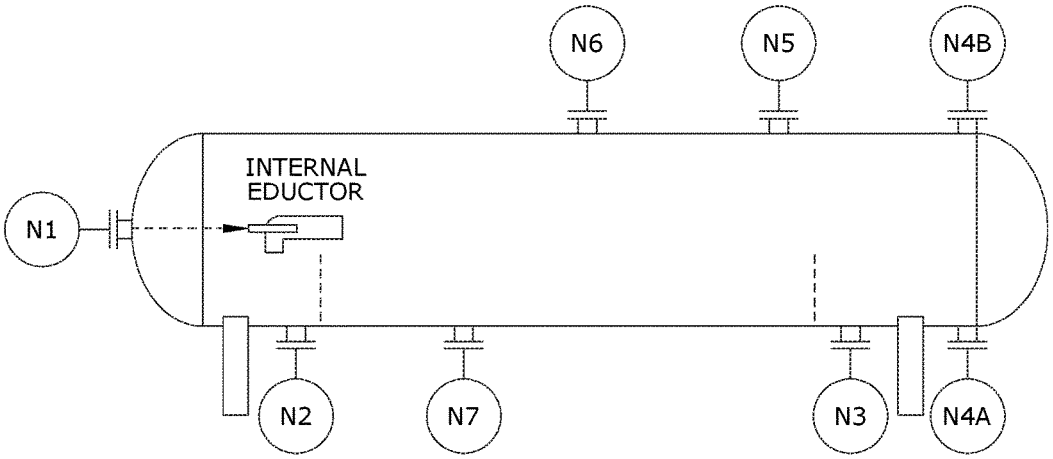
FIG. 2 is a schematic view of one embodiment of the butane/gasoline mixing vessel of the present disclosure.

By way of example, and referring to FIGS. 1 and 2, some embodiments of the present disclosure include a system for blending NGLs into hydrocarbon liquids, such as gasoline and crude oil, the system comprising at least one blend tank comprising an internal mixer eductor, a mixer, and a recirculation pump. The internal mixer eductor may create blending within the tank and may provide stability in the quality of the final product. In some embodiments, the consistency of the final blended product may be further improved by including at least one recirculation pump built into the system.

In a particular embodiment, a liquid hydrocarbon, such as gasoline or crude oil, may be measured and may flow into a first blend tank. An NGL, such as butane, to be mixed with the liquid hydrocarbon may flow into the first blend tank and may be mixed within the tank using an internal eductor. The resulting blend may then flow into a second blend tank, wherein more NGL may be added. If desired, a recirculation pump may be used to recirculate the product for more mixing and greater stability or to correct an off-spec product. Analyzers may continuously monitor the inlet and blended material at all parts of the process and may adjust the control system to provide an on-spec and consistent gasoline product quality. An exemplary process flow diagram for the system and method of the present disclosure is shown in FIG. 1. FIG. 2 shows an exemplary mixing or blending tank that may be suitable for use within the system of the present disclosure.

As shown in FIG. 1, the system may comprise multiple analyzers for improved blending. For example, an inlet analyzer (RVP analyzer 1) may measure Reid Vapor Pressure (RVP) of the incoming gasoline, which may be used to calculate an initial estimate for the NGL blend flow rate. A first outlet analyzer (RVP analyzer 2) may measure RVP and may be used to fine tune the NGL blend rate to achieve a safe but economic RVP target for the liquid hydrocarbon, wherein the RVP target may typically be within about 0.3 psia of the target vapor pressure. For example, if the target vapor pressure is 15.0 psia, then the RVP target may be about 14.7 psia. A second outlet analyzer (RVP analyzer 3) may also measure RVP, the value of which may be used to blend a natural gas liquid into a liquid hydrocarbon at an optimized value, wherein the optimized value may be within about 0.1 psia of the target vapor pressure. For example, the optimized value may be about 14.9 psia when the target vapor pressure is 15.0 psia. Thus, the analyzers may help provide a product with the desired or required NGL/liquid hydrocarbon volatility, which changes monthly or semi-monthly based on the time of year and is set forth for regulatory purposes in many state fuel handbooks in the United States. In summary, the incoming liquid hydrocarbon volatility may be measured by the inlet analyzer, and the initial NGL blend may be estimated based on a predetermined factor, wherein such predetermined factor is based on the daily or hourly average volatility of gasoline at the location. The secondary NGL blend may be estimated based on the initial blended liquid hydrocarbon volatility and a second predetermined factor, wherein the second predetermined factor is the daily or hourly effectiveness of incremental NGL addition to affect the desired outcome. The final liquid hydrocarbon/NGL volatility may be measured and the initial and second estimated may be adjusted, if needed, if the resulting volatility is in excess of the desired specification limit for RVP or hydrocarbon volatility.

In a particular embodiment, the system may include system for blending natural gas liquids into liquid hydrocarbons, the system comprising a first blending tank having a first tank inlet, a first tank outlet, and a first tank internal mixer eductor configured to blend a natural gas liquid and a liquid hydrocarbon held within the first blending tank, producing a first blend configured to flow out of the first tank outlet; an inlet analyzer configured to measure the RVP of the liquid hydrocarbon configured to flow into the first tank inlet; a first outlet analyzer configured to measure the RVP of the first blend flowing out of the first tank outlet; a second blending tank having a second tank inlet operatively connected to the first tank outlet, a second tank outlet, and a second tank internal mixer eductor configured to blend additional natural gas liquid with the blended natural gas liquid and liquid hydrocarbon, producing a second blend configured to exit the second blending tank through the second tank outlet; a second outlet analyzer configured to measure the RVP of the second blend flowing out of the second tank outlet; and optionally, at least one recirculation pump configured to recirculate a blended mixture through at least one member selected from the group consisting of the first blending tank and the second blending tank.

Gasoline from storage tanks may enter the system shown in FIG. 1 and, based upon its RVP and other allowable parameters, be blended with NGL, such as butane, in Blend Tank 1. The blended gasoline may flow past the RVP Analyzer 2 into Blend Tank 2 for checking of results. The RVP Analyzer 2 may check the achievement of the target predicted by an algorithm and initiated by a ratio controller. The trim control may call for more butane in the event that the algorithm determines more butane is needed to meet the targeted specifications. RVP Analyzer 3 may check the blend results of Blend Tank 2 and either approve the gasoline for downstream use according to the volatility specification or activate the recirculation pump to recycle the gasoline to Blend Tank 1 for further blending with gasoline from storage tanks to cure any off-specification product.

More specifically, as shown in FIG. 1, gasoline may enter the system from storage tanks and pass through a gasoline flow control, wherein its flow rate may be determined and controlled at the gasoline flow indicator controller (FIC) prior to entering Blend Tank 1. While the gasoline is entering the system, RVP analyzer 1 measures the RVP of the incoming gasoline. The RVP data is used to calculate an initial estimate for the NGL blend flow rate by using a predictive algorithm in a computer control system. The incoming gasoline is pumped into blend tank 1. Simultaneously, an NGL, such as butane from storage is pumped into blend tank 1, wherein the flow rate of the incoming NGL is controlled by ratio controller based on the RVP data from RVP analyzer 1 and other factors in the algorithm. The ratio controller may determine an appropriate flow of NGLs, such as butane, based on the algorithm, which considers the given flow and RVP of gasoline together with other parameters, such as liquid vapor ratio of the gasoline, the handbook requirements of the state or regulatory authority applicable to the time of year, user specifications, and incorporated modifications of recent learned history of the gasoline quality at the terminal. The butane from storage may enter the FIC as called upon by the ratio controller in the quantity desired for Blend Tank 1. Blending may occur at the eductor in Blend Tank 1. While in blend tank 1, the gasoline and the NGL are blending for about 1 minute to about 3 minutes, wherein an internal mixer eductor in the blend tank is mixing the hydrocarbons using the flow dynamics of the gasoline. Once the mixture in blend tank 1 has reached the exit of Blend Tank 1, the mixture flows into blend tank 2. During the transfer from blend tank 1 to blend tank 2, RVP analyzer 2 analyzes the RVP of the mixture to determine the NGL flow rate of NGL into blend tank 2. Once in blend tank 2, the mixture from blend tank 1 along with a volume of NGL from storage is blended for about 1 minute to about 3 minutes, wherein an internal mixer eductor in the blend tank is mixing the hydrocarbons using the flow dynamics of the mixture from blend tank 1. The mixture leaving tank 2 is analyzed by RVP analyzer 3 to ensure proper quality and that the product meets specification requirements. Provided that the output from mixing tank 2 meets all specification requirements, it is pumped out of the system. If needed or desired, the output from blend tank 2 may be recirculated through the system via a recirculation pump, wherein the output is mixed with the primary butane blend pumped into blend tank 1.

In embodiments, the system may be modularized for incremental installation as follows: (1) an initial single tank system may be added as a first step; (2) a second tank may be added in series with the first tank to get improved blending results; and (3) a recirculation pump may be added for further consistency and optimization. Each of the blend tanks must provide ample capacity for blending and mixing to occur within the tank for about 1 to about 3 minutes. The recirculation pump, when used, must provide for sufficient pressure increase to recycle the hydrocarbon product to blend tank 1.

The system of the present disclosure may be made and used as a standalone system with standard equipment arranged as a process unit, or the system may be skid mounted for easy manufacturing, transport, and hook up.

As compared to prior art systems, the system of the present disclosure may function as follows. If a prior art system targets an RVP of 14.5 psia RVP when the specification is 15.0 psia RVP due to the risk of off-specification product, the system of the present disclosure may target 14.9 psia RVP, thereby blending approximately twenty percent more butane into the gasoline while achieving assurance of an on-specification product.

The system of the present disclosure may retain the hydrocarbon product while it is blended with NGLs. The system may also certify that the blended product is on-specification after blending by before discharge into downstream trailers, tanks, barges, or pipelines. The system may provide a method to retain hydrocarbons, even if off-specification, and recycle the hydrocarbons in the blending apparatus. In embodiments, the system also provides for a method to blend the hydrocarbons more than once to further maximize blending and may provide a method to certify the specifications of the blend in both the primary and the secondary blending apparatus.

As a result of the structure of the system of the present disclosure, the method of blending NGLs into liquid hydrocarbons using the system may allow better mixing and control than conventional methods. The system and method of the present disclosure may also allow more natural gas liquids to be blended and may result in more consistent and accurate product quality. Because of the in-tank mixing and the continuous monitoring downstream of the blend point, the system and method of the present disclosure may provide a more consistent sample to analyze, may eliminate stratification and bad mixing, and may provide for continuous and accurate monitoring of the product.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A method for blending natural gas liquids into liquid hydrocarbons, the method comprising:

blending a natural gas liquid (NGL) and a liquid hydrocarbon in a first blending tank, producing a first blend;

measuring a Reid Vapor Pressure (RVP) of the liquid hydrocarbon before the liquid hydrocarbon enters the first blending tank;

measuring the RVP of the first blend flowing out of the first blending tank;

blending additional NGL with the first blend in a second blending tank, producing a second blend;

measuring the RVP of the second blend flowing out of the second blending tank to determine whether the second blend meets desired specifications; and if the second blend does not meet the desired specification, recirculating the second blend through at least one member selected from the group consisting of the first blending tank and the second blending tank, wherein:

the first blend tank includes a first tank internal mixer eductor; and the second blend tank includes a second tank internal mixer eductor.

2. The method of claim 1, wherein blending in the first blending tank lasts for about 1 minute to about 3 minutes.

3. The method of claim 1, wherein blending in the second blending tank lasts for about 1 minute to about 3 minutes.

4. The method of claim 1, wherein an acceptable RVP of the first blend is within about 0.3 psia of a target vapor pressure.

5. The method of claim 1, wherein an acceptable RVP of the second blend is within about 0.1 psia of a target vapor pressure.

* * * * *